US008840490B2

(12) United States Patent
Hayase et al.

(10) Patent No.: US 8,840,490 B2
(45) Date of Patent: Sep. 23, 2014

(54) GOLF CLUB HEAD

(75) Inventors: Seiji Hayase, Kobe (JP); Masahide Onuki, Kobe (JP); Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 568 days.

(21) Appl. No.: 13/072,812

(22) Filed: Mar. 28, 2011

(65) Prior Publication Data

US 2011/0312439 A1 Dec. 22, 2011

(30) Foreign Application Priority Data

Jun. 17, 2010 (JP) ..... 2010-138073

(51) Int. Cl.
*A63B 53/04* (2006.01)
*A63B 59/00* (2006.01)

(52) U.S. Cl.
CPC ..... *A63B 53/0466* (2013.01); *A63B 2053/0408* (2013.01); *A63B 2209/023* (2013.01); *A63B 2053/0416* (2013.01); *A63B 2059/0003* (2013.01); *A63B 2053/0458* (2013.01); *A63B 2053/0412* (2013.01); *A63B 59/0074* (2013.01); *A63B 2053/0433* (2013.01); *A63B 2209/00* (2013.01)
USPC ..... 473/345; 473/347; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 6,478,692 | B2 * | 11/2002 | Kosmatka | 473/342 |
| 6,991,560 | B2 * | 1/2006 | Tseng | 473/332 |
| 7,749,101 | B2 * | 7/2010 | Imamoto et al. | 473/332 |
| 7,850,545 | B2 * | 12/2010 | Wada et al. | 473/332 |
| 2002/0042307 | A1 * | 4/2002 | Deshmukh | 473/335 |
| 2003/0236132 | A1 | 12/2003 | Burrows | |

FOREIGN PATENT DOCUMENTS

| | | | |
|---|---|---|---|
| JP | 2002-35180 | A | 2/2002 |
| JP | 2002-126138 | A | 5/2002 |

OTHER PUBLICATIONS

"Production and Mechanical Property of Biomedical Porous Ti-Nb-Sn Alloy", The Japan Institute of Metals (Nihon-kinzoku gakkai), Annual autumn meeting (the 135th) outline (2004), p. 466.

* cited by examiner

*Primary Examiner* — Sebastiano Passaniti
(74) *Attorney, Agent, or Firm* — Birch, Stewart, Kolasch & Birch, LLP

(57) ABSTRACT

A golf club head 2 comprises: a porous part Ps including a porous metal and integrally formed; and a non-porous part NPs. The porous part Ps constitutes at least a part of a sole 8. The porous part Ps has a whole thickness part Pt occupying a whole thickness of the sole 8. Preferably, a rate Ra of an area occupied by the whole thickness part Pt among an area of the sole is equal to or greater than 15%. Preferably, the porous part Ps and the non-porous part NPs are welded mutually. In the disposal of the porous part Ps in the head 2, preferably, a substituted head obtained by substituting the porous part Ps with the same material as that of the non-porous part NPs adjacent to the porous part Ps is considered.

16 Claims, 14 Drawing Sheets

GOLF CLUB HEAD

This application claims priority on Patent Application No. 2010-138073 filed in JAPAN on Jun. 17, 2010, the entire contents of which are hereby incorporated by reference.

BACKGROUND OF THE INVENTION

1. Field of the Invention

The present invention relates to a golf club head.

2. Description of the Related Art

Regarding a material used for a golf club head, various proposals have been conducted. Japanese Patent Application Laid-Open No. 2002-35180 discloses a golf club head using a porous metal. Japanese Patent Application Laid-Open No. 2002-126138 discloses a head in which a porous metal is disposed in a head body made of a metal outer shell in order to enhance a hitting sound and hitting feel. A view showing the relationship between porosity and an elastic modulus of a porous metal made of a titanium alloy is described in The Japan Institute of Metals (Nihon-Kinzoku gakkai), Annual autumn meeting (the 135th) outline (2004), p. 466.

SUMMARY OF THE INVENTION

It was found that the porous metal can bring about a new function effect.

It is an object of the present invention to provide a golf club head capable of generating a high-pitch hitting sound.

A golf club head according to the present invention comprises: a porous part including a porous metal and integrally formed; and a non-porous part. The porous part constitutes at least a part of a sole. The porous part has a whole thickness part occupying a whole thickness of the sole.

Preferably, the porous part has two skin layers and a core layer located inside the skin layers, and porosity of each of the skin layers is smaller than that of the core layer.

Preferably, a rate Ra of an area occupied by the whole thickness part among an area of the sole is equal to or greater than 15%.

Preferably, the porous part and the non-porous part are welded mutually.

Preferably, when a natural frequency of a first-order mode of a substituted head obtained by substituting the porous part with the same material as that of the non-porous part adjacent to the porous part is Fp1, a natural frequency F1 of a first-order mode is greater than the natural frequency Fp1 of the substituted head. A substituted portion in the substituted head has the same weight as that of the porous part, has an outer surface common to that of the porous part, and has a uniform thickness.

Preferably, when a maximum amplitude point of the first-order mode of the substituted head is Pe1, the maximum amplitude point Pe1 is located in the whole thickness part.

Preferably, when a maximum amplitude of vibration of the first-order mode of the substituted head is set to Ma1; an amplitude ratio to the maximum amplitude Ma1 is set to Rh (%); and an area in which the amplitude ratio Rh is equal to or greater than 60% is defined as a high amplitude ratio area, the whole thickness part is disposed over the whole high amplitude ratio area.

According to the present invention, a high-pitch hitting sound can be obtained in a hollow golf club head.

DESCRIPTION OF THE PREFERRED EMBODIMENTS

Hereinafter, the present invention will be described in detail according to the preferred embodiments with appropriate references to the drawings.

Figure 1:
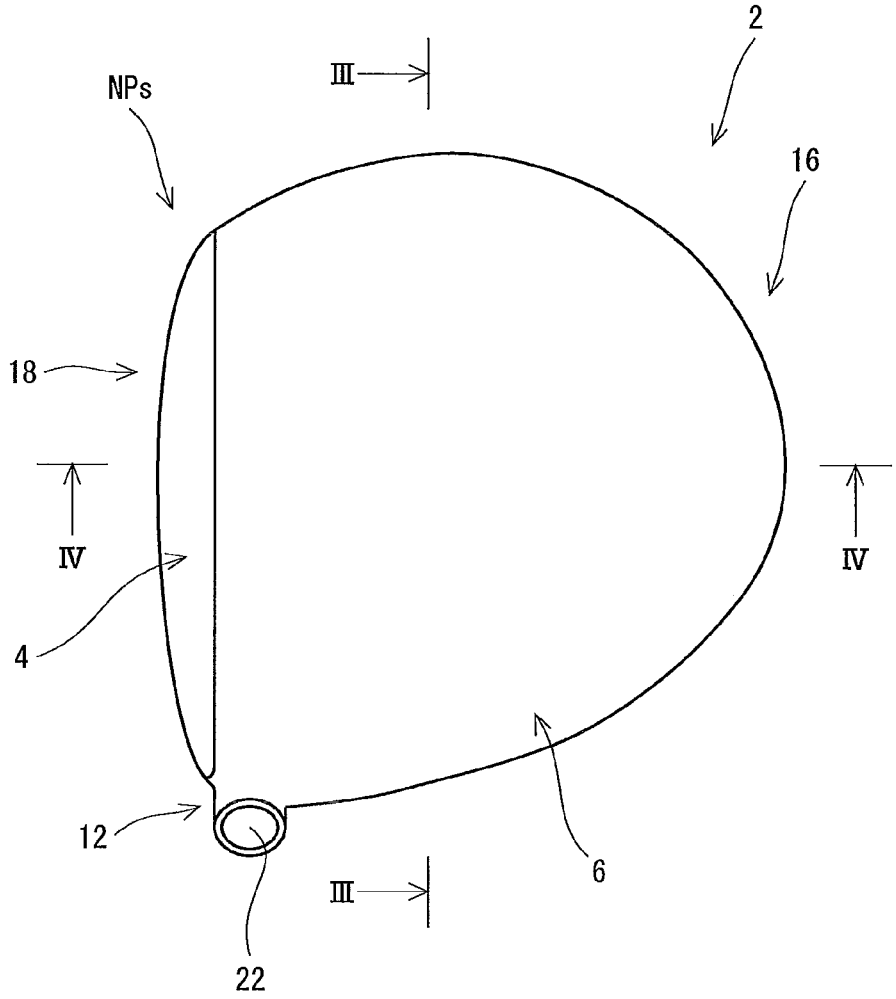
FIG. 1 is a view of a head according to one embodiment of the present invention, as viewed from a crown side.
Figure 2:
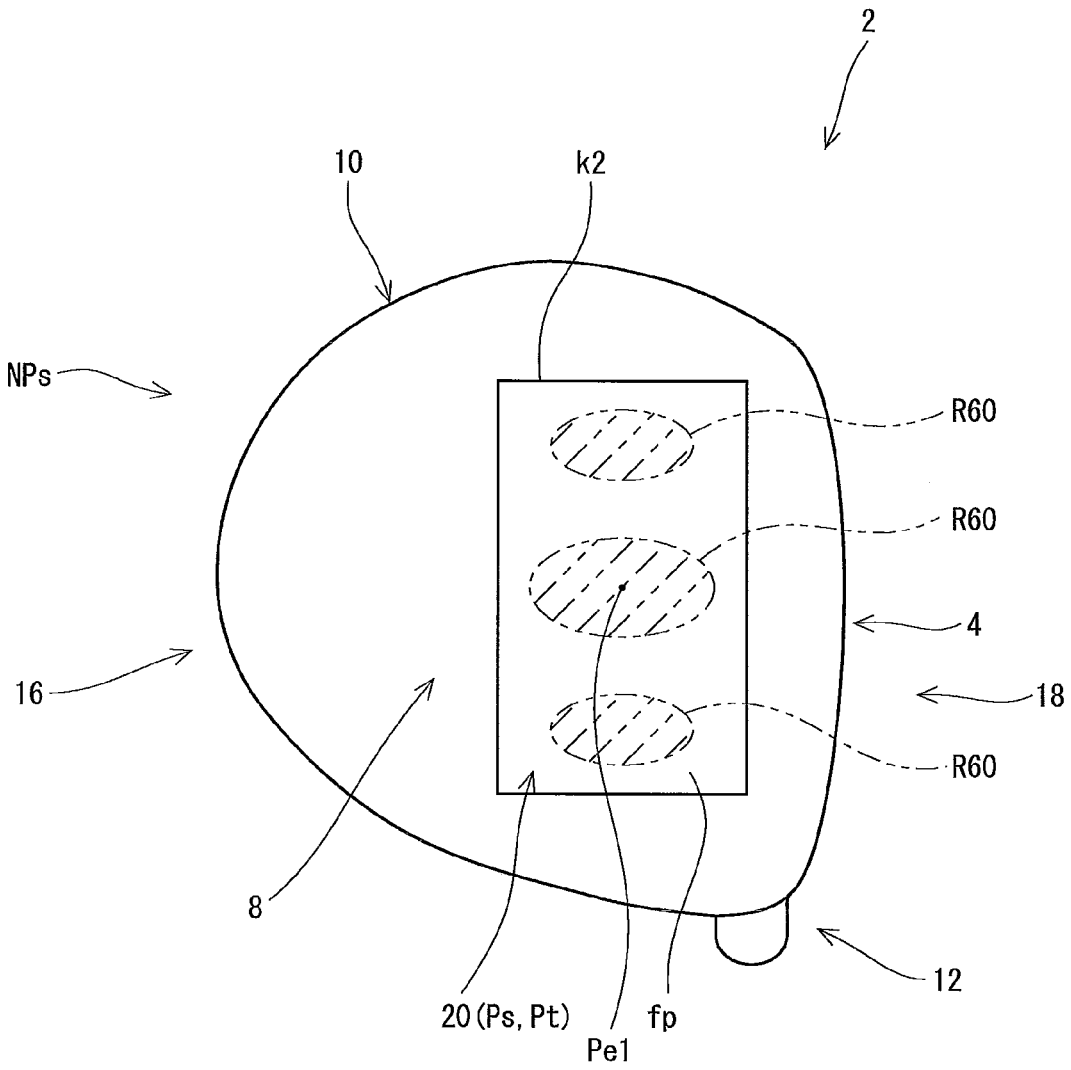
FIG. 2 is a view of the head of FIG. 1, as viewed from a sole side.
Figure 3:
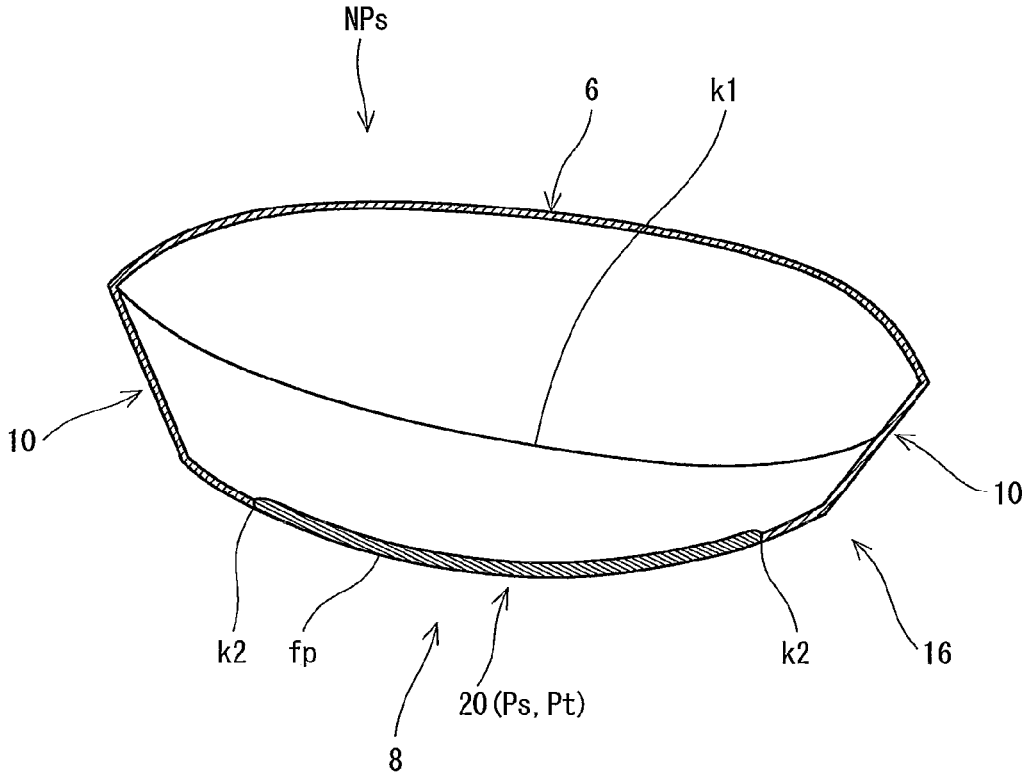
FIG. 3 is a sectional view taken along line III-III of FIG. 1.
Figure 4:
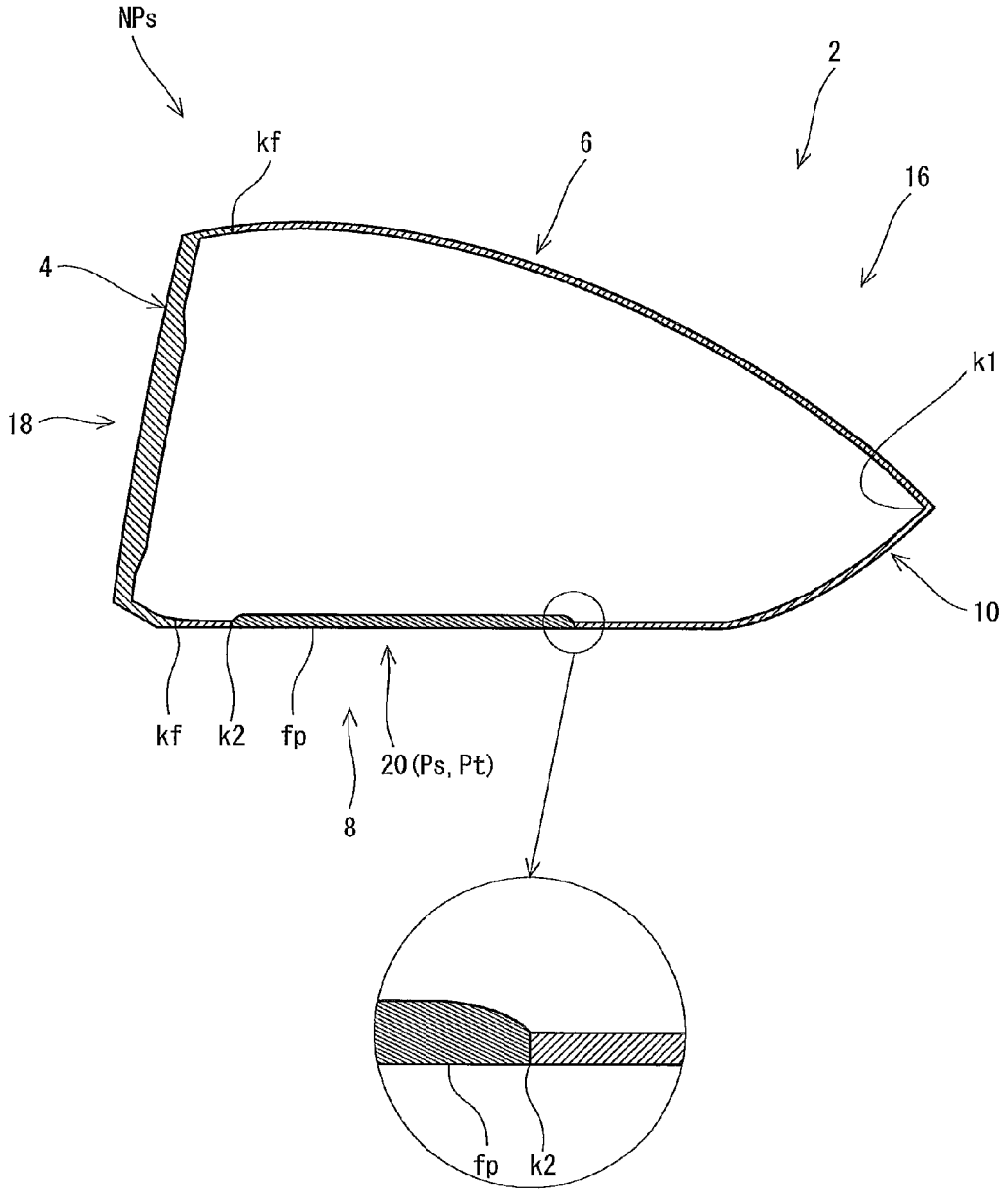
FIG. 4 is a sectional view taken along line IV-IV of FIG. 1.

A golf club head 2 shown in FIGS. 1 to 4 has a face 4, a crown 6, a sole 8, a side 10, and a hosel 12. The crown 6 extends toward the back of the head from the upper edge part of the face 4. The sole 8 extends toward the back of the head from the lower edge part of the face 4. The side 10 extends between the crown 6 and the sole 8. As shown in FIGS. 3 and 4, the inside of the head 2 is hollow. The head 2 is a hollow head. The head 2 is a so-called wood type golf club head.

As shown in FIGS. 3 and 4, a boundary k1 between the side 10 and the crown 6 exists on the inner surface of the head 2.

The side 10 may not exist. That is, the crown 6 and the sole 8 may be adjacent to each other. When the sole 8 and the crown 6 are smoothly continued, the side 10 is regarded as non-existence.

The head 2 is obtained by joining a plurality of members including a porous member. Specifically, the head 2 is obtained by joining a head body 16, a face member 18, and a porous member 20 (see FIG. 4). A joining method is welding. The porous member 20 and a member (head body 16) adjacent thereto can be welded mutually. All of the head body 16, the face member 18, and the porous member 20 are made of a titanium alloy. A boundary k2 between the porous member 20 and the head body 16 is shown in FIG. 2 or the like. A boundary kf between the head body 16 and the face member 18 is shown in FIG. 4.

The porous member 20 and a member (head body 16) adjacent to the porous member 20 are welded to integrate the porous member 20 with the head body 16. The welded porous member 20 functions as a structure of the head 2. The welding can enhance an improvement effect of a hitting sound caused by the porous member 20.

The face member 18 constitutes the whole face 4. Furthermore, the face member 18 constitutes a part of the crown 6, a part of the sole 8, and a part of the side 10. The face member 18 is approximately dish-formed (cup-formed). The face member 18 may be referred to as a cup face.

The head body 16 constitutes a part of the crown 6, a part of the sole 8, a part of the side 10, and the whole hosel 12. The body 16 has a through hole having a shape corresponding to that of the porous member 20. The through hole is located in the sole 8. The porous member 20 is disposed in the through hole.

The porous member 20 includes a porous metal. The whole porous member 20 is integrally formed. The whole porous member 20 may be the porous metal.

As shown in FIG. 1, the hosel 12 has a hole 22 to which a shaft is mounted. A shaft (not shown) is inserted into the hole 22.

In the present invention, a structure of the head and a method for manufacturing the head are not restricted.

In the present application, a porous part Ps is defined. The porous part Ps includes a porous metal. The whole porous part Ps is integrally formed. In the embodiment, a portion formed by the porous member 20 is the porous part Ps. The whole porous part Ps may be the porous metal.

In the present application, a non-porous part NPs is defined. The non-porous part NPs is a portion other than the porous part Ps. In the embodiment, the head body 16 and the face member 18 are the non-porous parts NPs.

The porous part Ps is located in the sole 8. The whole porous part Ps is located in the sole 8. The porous part Ps does not exist in a portion other than the sole 8. In the embodiment, the whole porous part Ps is located in the sole 8.

In the embodiment, a part of the sole 8 is the porous part Ps. The whole sole 8 may be the porous part Ps.

As shown in FIGS. 3 and 4, the porous part Ps occupies the whole thickness of the sole 8. In the present application, the porous part Ps occupying the whole thickness of the sole 8 is also referred to as a whole thickness part Pt. In the embodiment, the whole porous part Ps is the whole thickness part Pt. A part of the porous part Ps may be the whole thickness part Pt. One example thereof will be described later.

An outer surface of the whole thickness part Pt is exposed to the outside of the head 2. An inner surface of the whole thickness part Pt is exposed to a hollow part of the head 2.

The outer surface of the whole thickness part Pt constitutes a part of a sole surface. The sole surface is an outer surface of the sole 8. The outer surface of the whole thickness part Pt and an outer surface of the non-porous part NPs are smoothly continued.

The inner surface of the whole thickness part Pt is a smoothly continued curved surface.

As shown in FIGS. 3 and 4, a thickness of the whole thickness part Pt is greater than that of the non-porous part NPs adjacent to the whole thickness part Pt.

The porous part Ps and the non-porous part NPs are welded mutually. Specifically, the porous part Ps and the head body 16 are welded mutually. The porous part Ps and the non-porous part NPs are integrated by the welding. The welded porous part Ps functions as the structure of the head 2. The welding can enhance an improvement effect of a hitting sound caused by the porous part Ps.

[Substituted Head]

Figure 5:
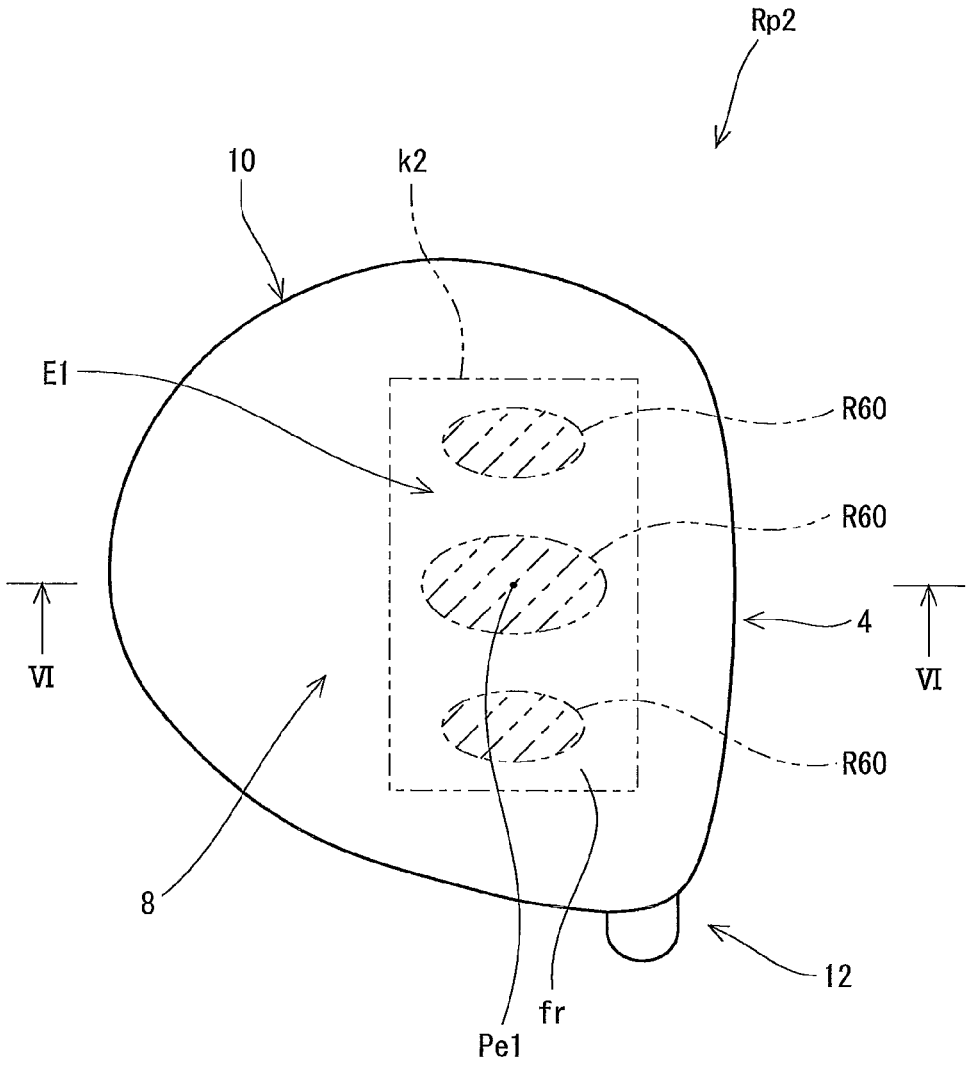
FIG. 5 is a view of a substituted head corresponding to the head of FIG. 1, as viewed from a sole side.
Figure 6:
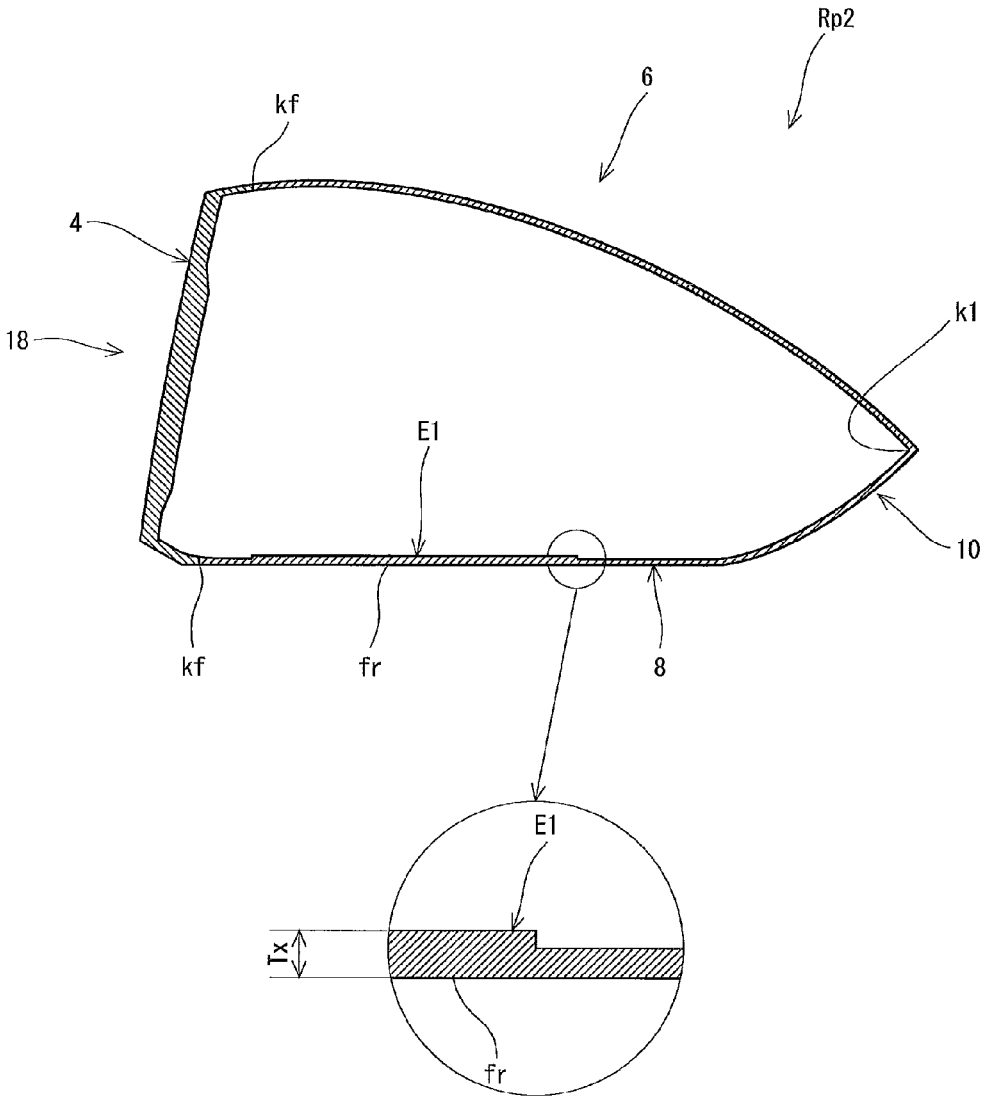
FIG. 6 is a sectional view taken along line VI-VI of FIG. 5.

FIGS. 5 and 6 show a substituted head Rp2 corresponding to the head 2. It is useful to analyze the substituted head Rp2 in order to determine the disposal of the porous part Ps in the head 2. The substituted head may be produced as an actual head, or may be produced as three-dimensional data for simulation.

Specifications of the substituted head Rp2 are as follows.

[Material of Substituted Portion in Substituted Head Rp2]

The porous part Ps of the head 2 is substituted with the same material as that of the non-porous part NPs. The same material as that of the non-porous part NPs means a material of the non-porous part NPs adjacent to the porous part Ps. In the embodiment, the head body 16 is adjacent to the porous part Ps. Therefore, the porous part Ps is substituted with a material of the head body 16. When a plurality of members are adjacent to the porous part Ps, a material of an adjacent member having the largest boundary face between the adjacent member and the porous part Ps is employed.

[Outer Surface of Substituted Portion E1 in Substituted Head Rp2]

An outer surface fr of a substituted portion E1 is made common to an outer surface fp of the porous part Ps.

[Thickness Tx of Substituted Portion E1 in Substituted Head Rp2]

A thickness Tx of the substituted portion E1 is made uniform (see FIG. 6). The thickness Tx is preferably greater than the mean thickness of the whole thickness part Pt.

[Weight Wx of Substituted Portion E1 in Substituted Head Rp2]

A weight Wx of the substituted portion E1 is made the same as a weight Wp of the porous part Ps.

The substituted head Rp2 thus set can provide information important for the design of the head 2. The disposal of the porous part Ps can be determined based on a result of vibration analysis of the substituted head Rp2.

As preferable vibration analysis, mode analysis is exemplified. Preferably, the disposal of the porous part Ps is determined based on a result of mode analysis of the substituted head Rp2.

In the mode analysis, a natural mode of the substituted head Rp2 is obtained. The natural mode is a vibration form peculiar to an object. Preferably, the natural mode of the whole substituted head Rp2 is considered.

The vibration analysis (mode analysis) can be utilized also for the analysis of the head 2. For example, an effect caused by the provision of the porous part Ps can be verified by comparing the analysis result of the substituted head Rp2 with the analysis result of the head 2.

A method for obtaining the natural mode is not restricted. A mode test (also referred to as experiment mode analysis) or mode analysis can be used. In the mode test, excitation experiment is conducted and the natural mode is obtained based on the result of the experiment. In the mode analysis, the natural mode is obtained by simulation. In the simulation, for example, a finite element method may be used. The methods of the mode test and the mode analysis are known.

Preferably, the mode test or the mode analysis is conducted under a free support condition. That is, a constraint condition is made free. In the mode analysis, for example, commercially available natural value analyzing software is used. "ABAQUS" (trade name) (manufactured by ABAQUS INC.), MARC (manufactured by MSC SOFT) and "IDEAS" (manufactured by EDS PLM Solutions) are exemplified as the software.

In examples to be described later, the mode analysis using the natural value analyzing software is conducted. In the mode test by actual measurement, for example, a thread is fixed to any position of the head (for example, an end face of a neck). Each of parts of the head is struck by an impact hammer in a state where the head is hung with the thread. The mode is obtained by measuring a transfer function with acceleration response of a center of a face.

A natural frequency is obtained in the mode analysis. The "natural frequency" of the present application is a natural frequency of the head. An effect caused by the porous part Ps can be confirmed by comparing a natural frequency of the substituted head Rp2 with a natural frequency of the head 2.

"A natural frequency in an N-th order mode" (also referred to as an N-th order natural frequency) of the present application is "an N-th natural frequency counted from the smallest natural frequency among the natural frequencies of the whole head". N is an integer of equal to or greater than 1. A rigidity mode in which the head is not deformed is not counted as the order. For example, "a first-order natural frequency" is "a first-order natural frequency of the whole head". For example, "a second-order natural frequency" is "a second-order natural frequency of the whole head". When "the N-th order natural frequency" is merely described in the present application, "the N-th order natural frequency" means the N-th order natural frequency of the whole head. When "the N-th order natural frequency of the head" is described in the present application, "the N-th order natural frequency of the head" means the N-th order natural frequency of the whole head.

"A natural frequency of a first-order mode" is the smallest natural frequency among the natural frequencies of the head. "A natural frequency in a second-order mode" is a second smallest natural frequency. "A natural frequency in a third-order mode" is a third smallest natural frequency. "A natural frequency in an N-th order mode" is an N-th smallest natural frequency. Increase of the natural frequency of the first-order mode is considered to be most effective in order to enhance a high-pitch hitting sound.

"An N-th order mode" of the present application is "an N-th order natural mode of the whole head". N is an integer of equal to or greater than 1. For example, "a first-order mode" is "a first-order natural mode of the whole head". For example, "a second-order mode" is "a second-order natural mode of the whole head". When "the N-th order mode" is merely described in the present application, "the N-th order mode" means the N-th order natural mode of the whole head. When "the N-th order mode of the head" is described in the present application, "the N-th order mode of the head" means the N-th order natural mode of the whole head.

[Maximum Amplitude Point, Maximum Amplitude]

In the N-th order natural mode, a point having the greatest amplitude is a maximum amplitude point. For example, the maximum amplitude point of the first-order mode is a point having the greatest amplitude in the first-order mode.

[Amplitude Ratio Rh]

An amplitude rate to a maximum amplitude Ma1 in vibration of the first-order mode is defined as an amplitude ratio Rh (%). The amplitude ratio Rh is determined in the vibration of the first-order mode in the substituted head Rp2.

[High Amplitude Ratio Area]

"A high amplitude ratio area" means an area having the amplitude ratio Rh (%) of equal to or greater than 60%. Typically, the high amplitude ratio area is located in the sole 8. The number of the high amplitude ratio areas is a singular number or a plural number. For example, in a large-sized head having a volume of equal to or greater than 400 cc, the number of the high amplitude ratio areas tends to be a plural number. In respect of accelerating the effect of the present invention, all the high amplitude ratio areas are preferably located in the sole in the head 2.

The natural frequency of the first-order mode of the substituted head Rp2 is defined as Fp1. The natural frequency of the first-order mode of the head 2 is defined as F1. In this case, preferably, the natural frequency F1 is greater than the natural frequency Fp1. This shows that a high-pitch hitting sound can be obtained without increasing a weight.

A maximum amplitude point Pe1 of the first-order mode is shown in FIG. 5. Furthermore, high amplitude ratio areas R60 are shown by hatching of a two-dots-and-dash line in FIG. 5. As shown in examples to be described later, the high amplitude ratio areas R60 can be easily indicated using the simulation software. In the embodiment of FIG. 5, the high amplitude ratio areas R60 exist at three places.

As shown in FIG. 5, the maximum amplitude point Pe1 of the first-order mode is determined in the substituted head Rp2. In FIG. 2, the maximum amplitude point Pe1 of the first-order mode determined in the substituted head Rp2 is transferred to the head 2. As shown in FIG. 2, the maximum amplitude point Pe1 is located in the whole thickness part Pt in the head 2. In this case, the natural frequency F1 of the first-order mode tends to be increased. The high natural frequency F1 contributes to a high-pitch hitting sound.

As shown in FIG. 5, the high amplitude ratio areas R60 are determined in the substituted head Rp2. In FIG. 2, the high amplitude ratio areas R60 determined in the substituted head Rp2 are transferred to the head 2. As shown in FIG. 2, in the head 2, the whole thickness part Pt is disposed over all the high amplitude ratio areas R60. In this case, the natural frequency F1 of the first-order mode tends to be increased. The high natural frequency F1 contributes to a high-pitch hitting sound.

Figure 7:
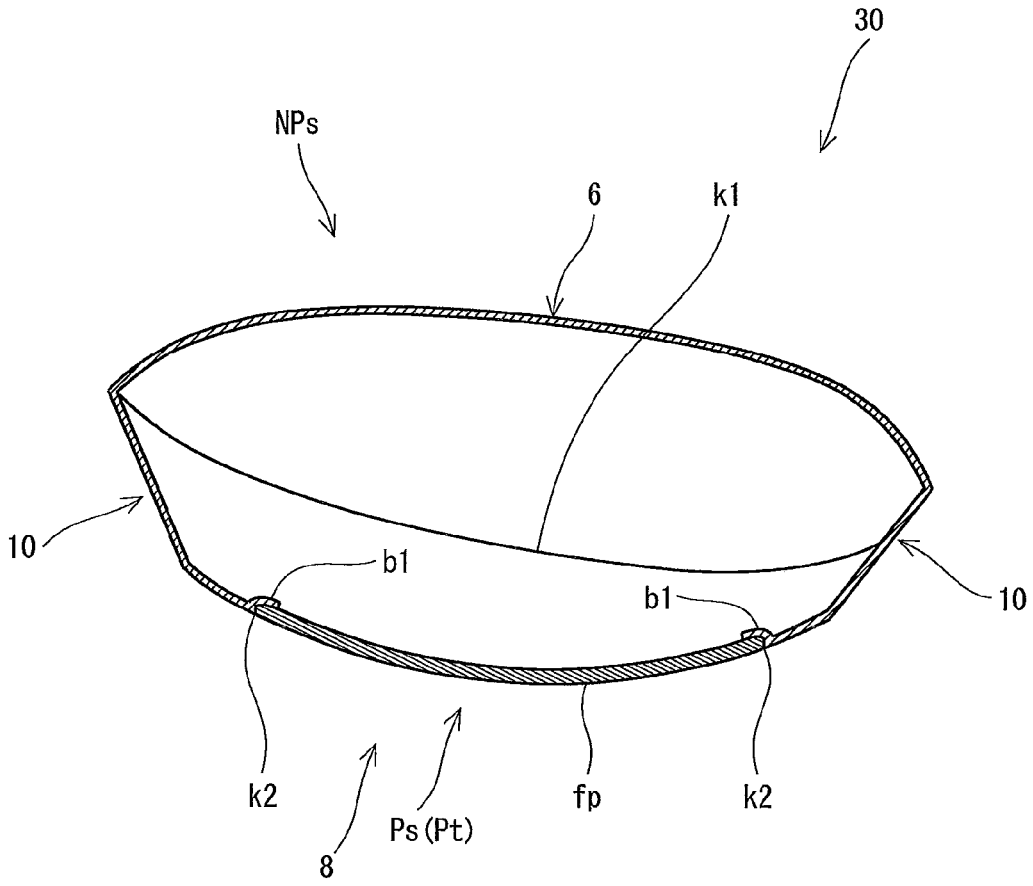
FIG. 7 is a sectional view of a head according to another embodiment.
Figure 8:
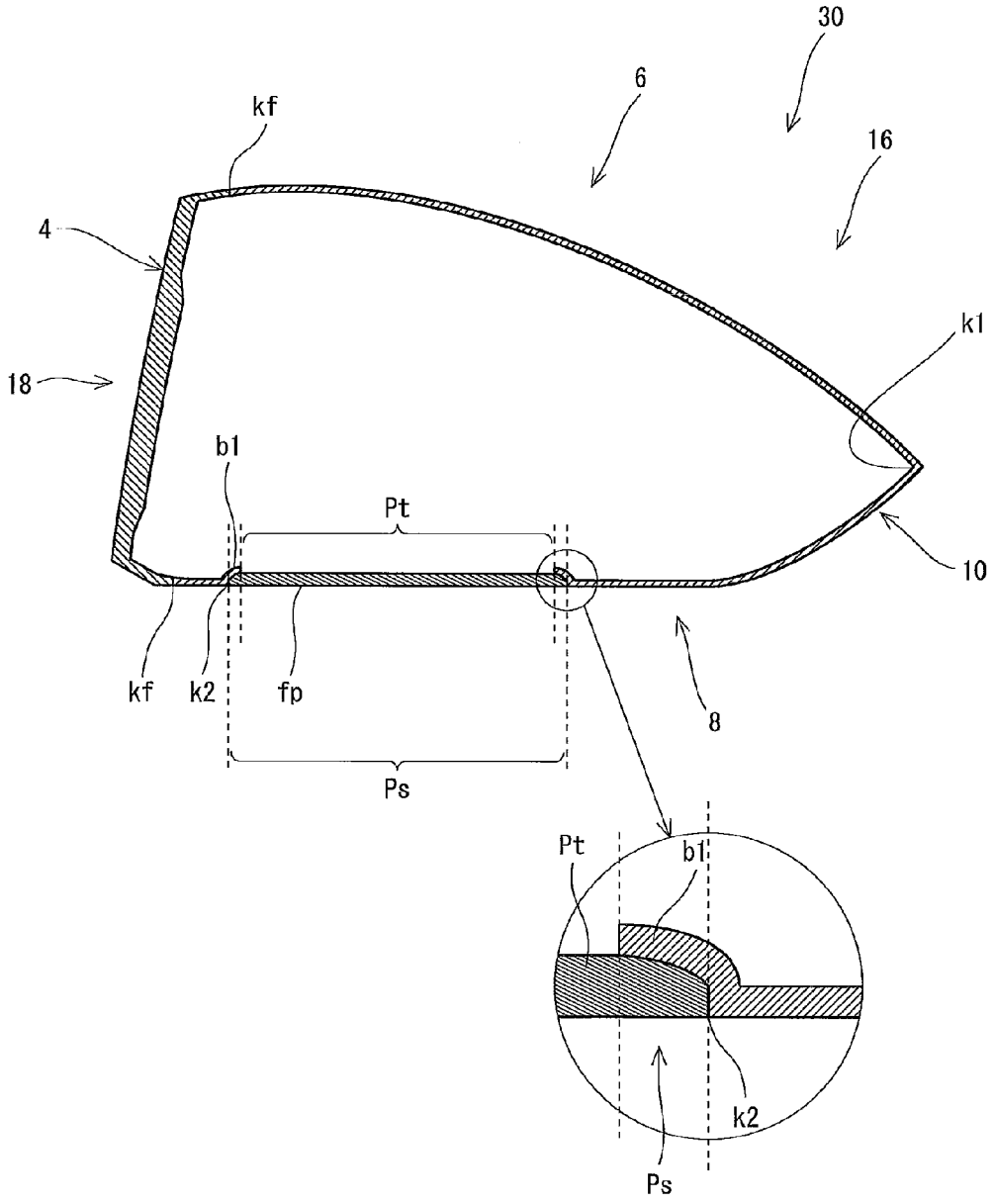
FIG. 8 is another sectional view of the head of FIG. 7.

FIGS. 7 and 8 are sectional views of a head 30 according to another embodiment. The head 30 has a backup part b1 supporting the porous part Ps from the inner side of the head (see an enlarged part of FIG. 8). The backup part b1 is provided around the porous part Ps. The head 30 is the same as the head 2 except that the backup part b1 exists.

The backup part b1 can enhance joining strength of the porous part Ps. The backup part b1 can make a joining process of the porous part Ps more efficient.

Unlike the above-mentioned head 2, in the head 30, the whole thickness part Pt and the porous part Ps are different to each other. In the porous part Ps, a portion on which the backup part b1 does not exist is the whole thickness part Pt (see FIG. 8).

Figure 9:
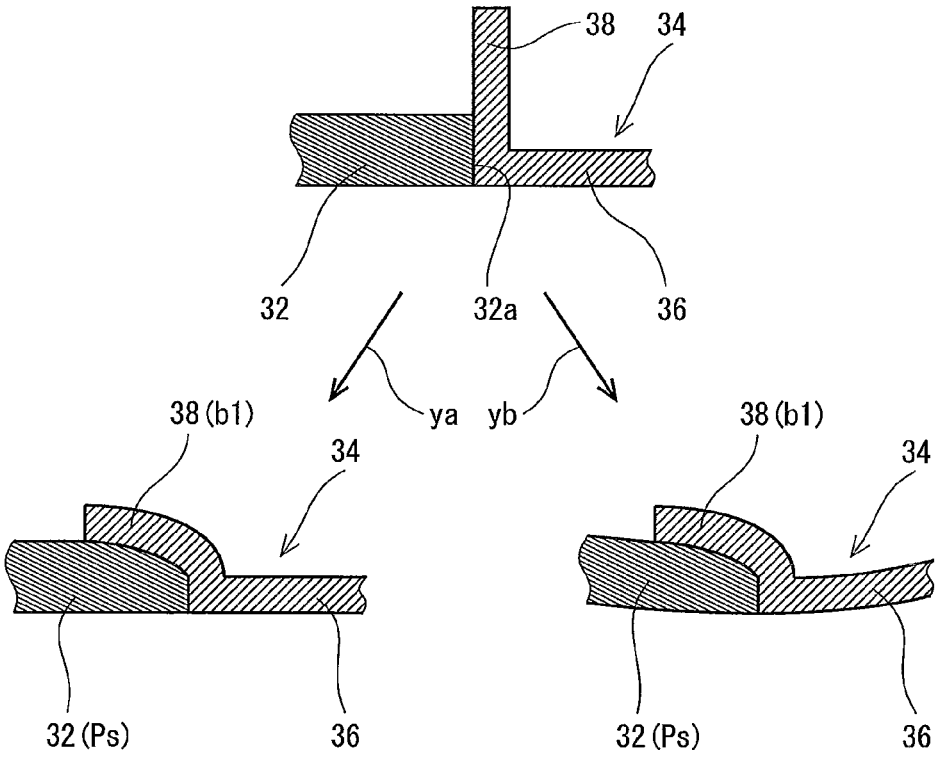
FIG. 9 is a sectional view for describing a manufacturing process of the head of FIG. 7.

FIG. 9 is a sectional view for describing one process of a manufacturing method of the head 30. In the process, a porous member 32 and an adjacent member 34 adjacent to the porous member 32 are prepared. The porous member 32 has a uniform thickness. The adjacent member 34 has a base part 36 and an upright part 38. In the process, first, an end face 32*a* of the porous member 32 is made to abut on the upright part 38. Next, a press processing is conducted. In the press processing, the upright part 38 is brought down to the porous member 32 side. At the same time, the porous member 32 is pressed by the upright part 38 to compressive-deform the porous member 32 (see an arrow ya). More preferably, in the press processing, the porous member 32 and the base part 36 are bent (see an arrow yb). The bending can form the last shape of the sole surface. Since the porous member 32 contains pores, the porous member 32 is easy to be deformed by pressing by the upright part 38. An edge part of the porous member 32 (porous part Ps) is deformed into a shape going along the backup part b1. Therefore, the edge part of the porous member 32 (porous part Ps) is certainly made to abut on the backup part b1. The structure enhances the joining strength of the porous part Ps. Since the process deforms the upright part 38 and the porous member 32 simultaneously, the process is excellent in productivity. Preferably, after the press processing, the porous member 32 and the adjacent member 34 are welded.

Figure 10:
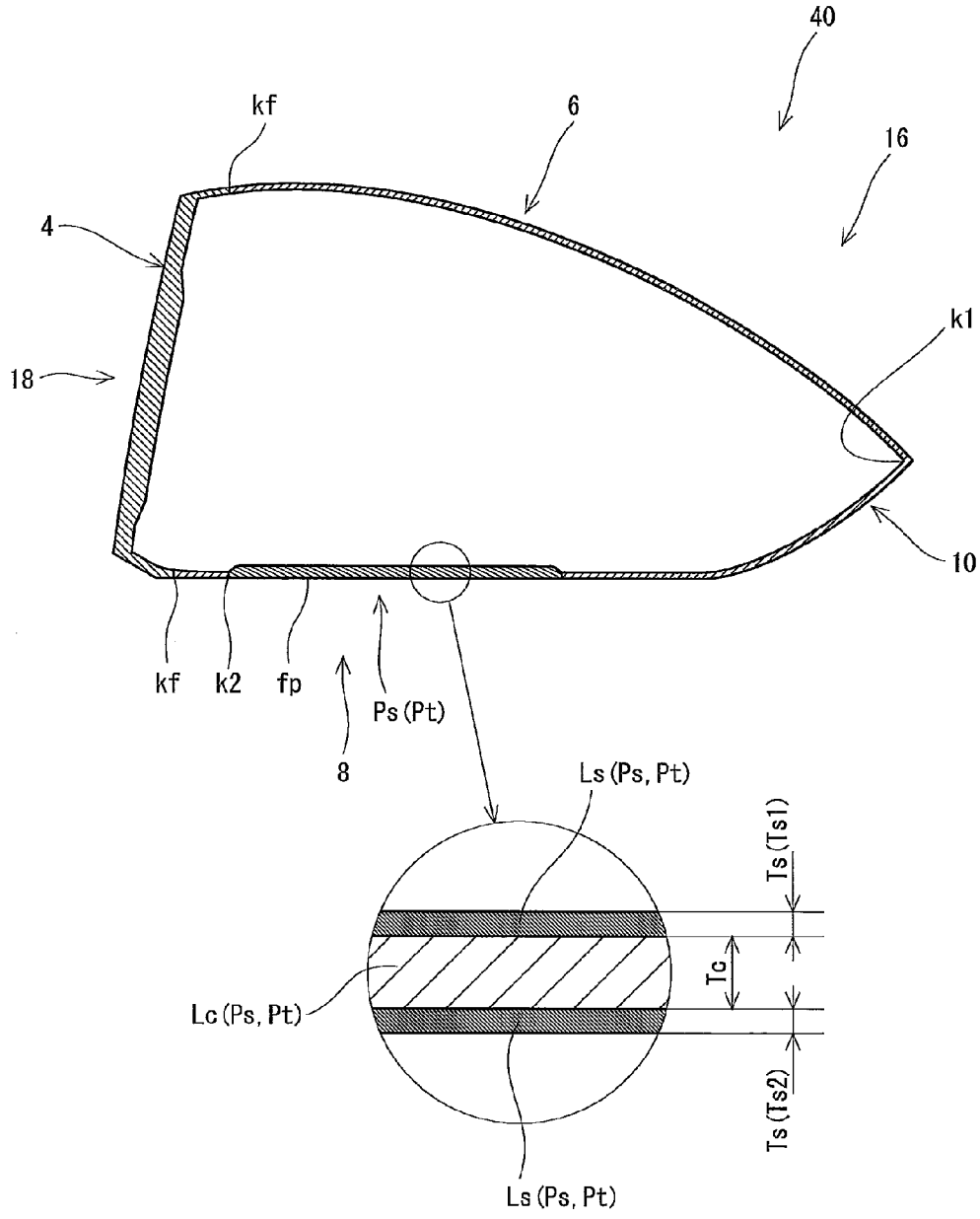
FIG. 10 is a sectional view of a head according to still another embodiment.

FIG. 10 is a sectional view of a head 40 according to another embodiment. In the head 40, a porous part Ps (whole thickness part Pt) has a three-layer structure. As an enlarged part of FIG. 10 shows, the porous part Ps (whole thickness part Pt) has two skin layers Ls and a core layer Lc. The core layer Lc is located inside the two skin layers Ls. The core layer Lc is located between the first skin layer Ls and the second skin layer Ls.

Porosity of the skin layer Ls is smaller than that of the core layer Lc. The skin layer Ls having small porosity enhances rigidity of the porous part Ps. The core layer Lc having great porosity contributes to reduction of a weight (specific gravity) of the porous part Ps. The core layer Lc having great porosity can suppress the weight of the porous part Ps, and can increase the thickness of the porous part Ps. The increase of the thickness can enhance the rigidity of the porous part Ps. The porous part Ps having the skin layers Ls and the core layer Lc together can achieve high rigidity and lightweight properties. The porous part Ps having the structure contributes the increase of the natural frequency. The porous part Ps having the structure contributes to enhancement of a high-pitch hitting sound.

Since the skin layer Ls forming an outer surface of the head has small porosity, the pores are inconspicuous. Therefore, the appearance of the head can be enhanced. The skin layer Ls forming the outer surface of the head suppresses soil and a lawn or the like which may adhere to a sole surface in hitting a ball from coming in the pores.

The porosity of the skin layer Ls is not restricted. In respect of enhancing the rigidity of the porous part Ps, the porosity of the skin layer Ls is preferably equal to or less than 5% (0.05), more preferably equal to or less than 1% (0.01), and still more preferably equal to or less than 0.5%. The porosity of the skin layer Ls may be 0% (0.00%). The porosity in the present application is % by volume.

The porosity of the core layer Lc is not restricted. The thickness of the porous part Ps can be increased while the weight of the porous part Ps can be suppressed by lowering the specific gravity of the porous part Ps. The increase of the thickness of the porous part Ps enhances the rigidity of the porous part Ps. The high rigidity is useful for increasing the natural frequency. In these respects, the porosity of the core layer Lc is preferably equal to or greater than 25% (0.25), and more preferably equal to or greater than 30% (0.30). In respects of rigidity and of strength, the porosity of the core layer Lc is preferably equal to or less than 80% (0.80), more preferably equal to or less than 70% (0.70), still more preferably equal to or less than 60% (0.60), and particularly preferably equal to or less than 50% (0.50).

A manufacturing method of the porous member having the skin layers Ls and the core layer Lc is not restricted. As the manufacturing method, there is exemplified a method for separately forming a material for the skin layer Ls and a material for the skin layer Ls, and thereafter integrating the formed materials to obtain a porous member.

A thickness Ts of the skin layer Ls is not restricted. That is, a thickness Ts1 of the first skin layer Ls and a thickness Ts2 of the second skin layer Ls is not restricted. In respect of lowering the specific gravity of the porous part Ps, the thickness Ts of the skin layer Ls is preferably thinner than a thickness Tc of the core layer Lc. In respect of lowering the specific gravity of the porous part Ps, the thickness Ts is preferably equal to or less than 0.5 mm, more preferably equal to or less than 0.4 mm, and still more preferably equal to or less than 0.3 mm. In respect of enhancing the rigidity of the porous part Ps, the thickness Ts is preferably equal to or greater than 0.05 mm, and more preferably equal to or greater than 0.1 mm.

The thickness Tc of the core layer Lc is not restricted. In respects of lowering the specific gravity of the porous part Ps and of enhancing the rigidity of the porous part Ps, the thickness Tc is preferably equal to or greater than 0.2 mm, more preferably equal to or greater than 0.3 mm, and still more preferably equal to or greater than 0.4 mm. An upper limit value of the thickness Tc is suitably set by a setting weight of the porous part Ps. For example, the upper limit value can be set to be equal to or less than 1.0 mm, further equal to or less than 0.8 mm, and still further equal to or less than 0.6 mm.

A ratio (also referred to as a skin layer ratio in the present application) of the thickness of the skin layer Ls to the whole thickness of the porous part Ps is not restricted. The skin layer ratio (%) is calculated by the following formula.

$$\text{Skin Layer Ratio (\%)}=[(Ts1+Ts2)/(Ts1+Ts2+Tc)]\times 100$$

In respect of increasing rigidity of a surface layer of the porous part Ps to enhance the hitting sound, the skin layer ratio is preferably equal to or greater than 8%, more preferably equal to or greater than 10%, still more preferably equal to or greater than 20%, and yet still more preferably equal to or greater than 30%. In respect of increasing the thickness of the porous part Ps to enhance the rigidity of the porous part Ps, the skin layer ratio is preferably equal to or less than 80%, more preferably equal to or less than 70%, still more preferably equal to or less than 60%, and yet still more preferably equal to or less than 50%.

As described above, the porous part Ps disposed in the sole can increase the first-order natural frequency. In respect of the high-pitch hitting sound, a rate Ra of an area Ap occupied by the whole thickness part in the sole to a sole area As is preferably equal to or greater than 15%, more preferably equal to or greater than 20%, still more preferably equal to or greater than 30%, and yet still more preferably equal to or greater than 40%. The rate Ra may be 100%.

The volume of the head is not restricted. In the large-sized head, a pitch of the hitting sound tends to be lowered. Therefore, in the large-sized head, an effect of enhancing the pitch of the hitting sound tends to be increased. In this respect, the volume of the head is preferably equal to or greater than 400 cc, more preferably equal to or greater than 420 cc, and still more preferably equal to or greater than 440 cc. In respect of conforming the rules for the golf club, the volume of the head is preferably equal to or less than 470 cc, and particularly preferably 460 cc±10 cc when the error of measurement of 10 cc is considered.

When the natural frequency F1 of the first-order mode is high, the pitch of the hitting sound in actual hitting also tends to be enhanced. In this respect, the natural frequency F1 is preferably equal to or greater than 2000 Hz, more preferably equal to or greater than 2500 Hz, and still more preferably equal to or greater than 2700 HZ. When the natural frequency F1 is excessively high, rebound performance may be reduced, and there is limit on the design of the head. In these respects, the natural frequency F1 can be also set to be equal to or less than 5000 Hz, and further equal to or less than 4000 Hz.

When the sole is thin, the effect caused by the porous part Ps tends to be increased. In this respect, a mean thickness of the sole in a portion other than the porous part Ps is preferably equal to or less than 1 mm, more preferably equal to or less than 0.8 mm, and still more preferably equal to or less than 0.7 mm. In respect of the strength of the head, the mean thickness of the sole in the portion other than the porous part Ps is preferably equal to or greater than 0.5 mm.

The material of the non-porous part NPs is not restricted. As the material of the non-porous part NPs, a metal and Carbon Fiber Reinforced Plastic (CFRP) or the like are exemplified. As the metal used for the non-porous part NPs, one or more kinds of metals selected from pure titanium, a titanium alloy, stainless steel, maraging steel, an aluminium alloy, a magnesium alloy, and a tungsten-nickel alloy are exemplified. SUS630 and SUS304 are exemplified as stainless steel. As the titanium alloy, 6-4 titanium (Ti-6A1-4V) and Ti-15V-3Cr-3Sn-3A1 or the like are exemplified. As described above, the present invention is particularly effective in a head having a loud hitting sound. In this respect, the material of the non-porous part NPs is preferably made of the titanium alloy. In this respect, the material of the sole is preferably the titanium alloy. When the non-porous part NPs is made of the titanium alloy, the porous part Ps is also preferably the titanium alloy in respect of weld strength.

A manufacturing method of the head is not restricted. Ordinarily, a hollow head is manufactured by joining two or more members. A preferable head is manufactured by joining two or more members including the porous member. A manufacturing method of each of the members is not restricted. As the method, casting, forging, and press forming are exemplified.

A manufacturing method of the porous member is not restricted. As the manufacturing method, a known method can be employed. As the manufacturing method, a metal powder injection molding (MIM) method, a method of shaping metal powder by compression, a method of sintering and molding metal powder, and a method of injecting gas into melted metal, or the like are exemplified.

The metal powder injection molding method includes the steps of: mixing a binder containing a resin and/or a wax with metal powder to obtain a mixture; injection-molding the mixture into a mold; degreasing the binder; and sintering the mixture after the degreasing step.

The porous metal capable of being formed by these manufacturing methods has a large number of small pores. The size of the pore is ordinarily about 10 nm or greater and about 1 mm or less. In respects of rigidity and of strength, the size of the pore is preferably equal to or less than 100 μm. A ratio of a volume of the pores to the volume of the whole porous metal is porosity.

EXAMPLES

Hereinafter, the effects of the present invention will be clarified by examples. However, the present invention should not be interpreted in a limited way based on the description of the examples.

In the following evaluation A, a natural frequency of a head was confirmed. In the following evaluation B, effects of a thickness of a skin layer and porosity of a core layer on rigidity were confirmed.

[Evaluation A: Natural Frequency of Head]

[Head Hr (Substituted Head)]

Three-dimensional data of a head Hr was produced in the same manner as in the substituted head Rp2 except that a thickness of a sole was made constant. The head Hr is a substituted head for heads C1 to C4 to be described later. A thickness of a crown of the head was set to 0.5 (mm); a thickness of a sole was set to 0.7 mm; and a volume of the head was set to 460 cc. A titanium alloy was selected as a material of the head. As physical property values of the titanium alloy, an elastic modulus was set to 126 GPa; a density was set to 4420 kg/m$^3$; and a Poisson ratio was set to 0.35. The titanium alloy was defined as an isotropic elastic body. A weight of the head was set to 190.6 g.

The head Hr was mesh-divided into finite elements using a commercially available preprocessor (HyperMesh or the like) to obtain a calculation model. Next, natural value analysis was conducted using commercially available natural value analyzing software to calculate a natural frequency and a mode shape. Division lines of mesh division are shown in FIG. 11.

Figure 11:
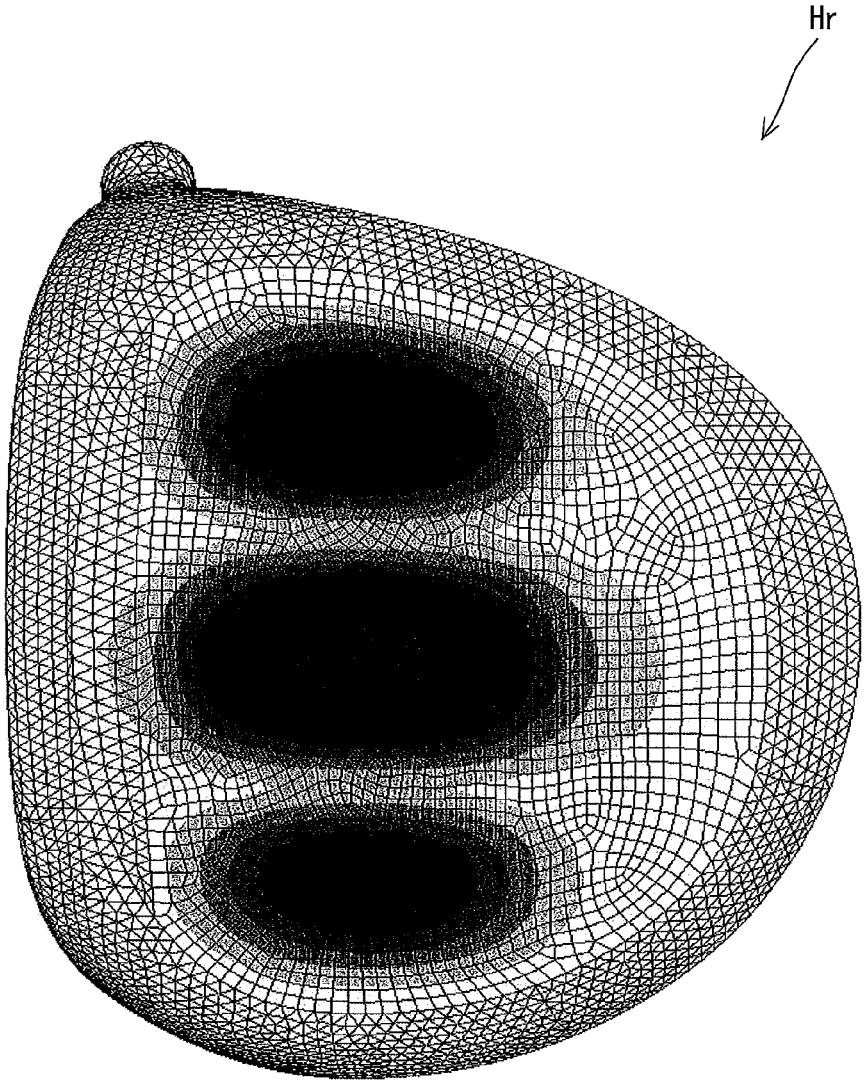
FIG. 11 is a simulation image of a substituted head Hr according to examples.

FIG. 11 is an image showing a simulation result of the mesh-divided head Hr. FIG. 11 is an image viewed from a sole side, and shows a vibration form of a sole. A contrasting density of FIG. 11 shows a form of natural vibration of a first-order mode. A deeper portion has a greater amplitude.

[Heads C1 to C4]

Figure 12:
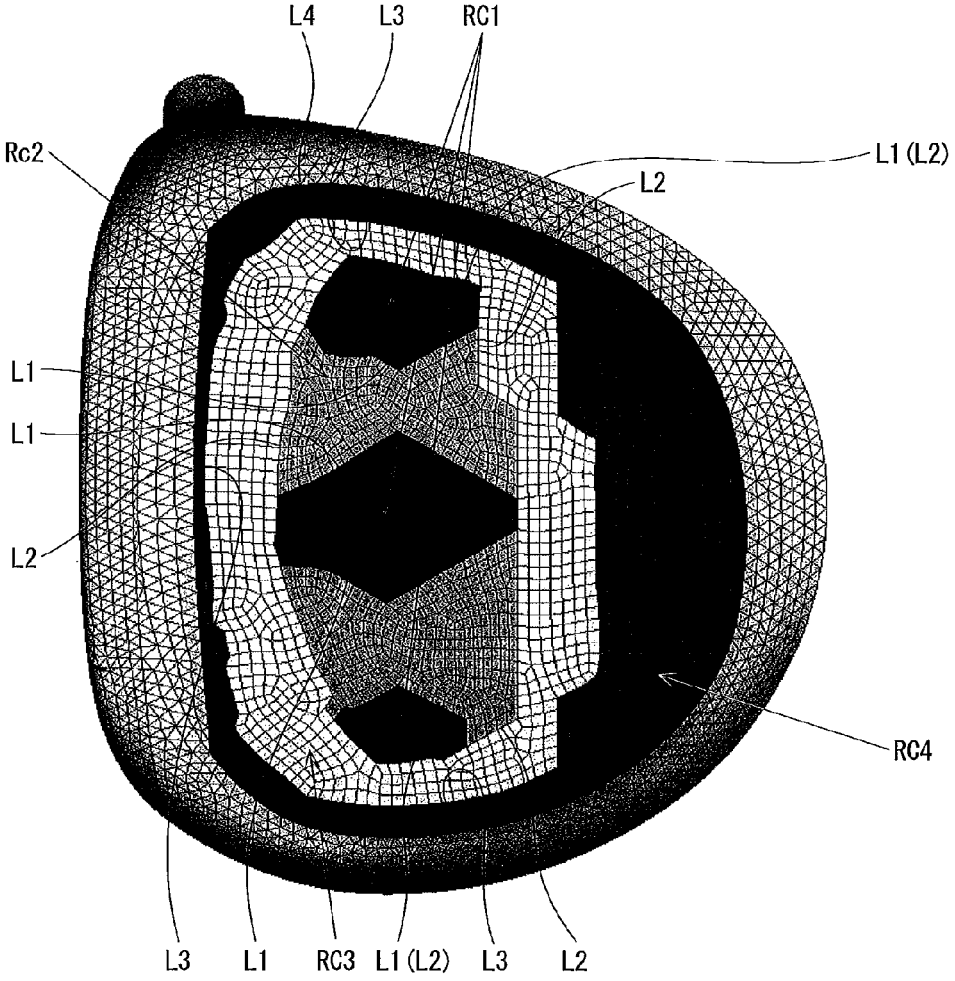
FIG. 12 is a view showing a position of a porous part Ps in each of the examples.

Four kinds of heads having the head Hr as the substituted head were examined. FIG. 12 shows positions of porous parts Ps in the four kinds of heads C1, C2, C3, and C4.

Lines L1 in FIG. 12 show contour lines of porous parts Ps of the head C1. Three-dimensional data of the head C1 was produced in the same manner as in the head 2 except that all areas RC1 inside the lines L1 were the porous parts Ps. The three-dimensional data of the head C1 was produced so that a substituted head of the head C1 was the head Hr.

The areas RC1 of the porous parts Ps in the head C1 exist at three places. The three places correspond to positions of antinodes in vibration of the first-order mode of the head Hr. The areas RC1 of the porous parts Ps in the head C1 are substantially equal to the high amplitude ratio area (an area in which an amplitude ratio Rh is equal to or greater than 60%). The area rate Ra of the porous parts Ps was 15%.

A line L2 in FIG. 12 shows a contour line of a porous part Ps of the head C2. Three-dimensional data of the head C2 was produced in the same manner as in the head 2 except that a whole area RC2 inside the line L2 was the porous part Ps. The three-dimensional data of the head C2 was produced so that a substituted head of the head C2 was the head Hr. The area RC2 of the porous part Ps in the head C2 is larger than the areas RC1 of the porous parts Ps in the head C1. The area RC2 of the porous part Ps in the head C2 includes all the areas RC1 of the porous parts Ps in the head C1. The area rate Ra of the porous part Ps was 32%.

A line L3 in FIG. 12 shows a contour line of a porous part Ps of the head C3. The line L3 is a contour line outside the palest portion in FIG. 12. Three-dimensional data of the head C3 was produced in the same manner as in the head 2 except that a whole area RC3 inside the line L3 was the porous part Ps. The three-dimensional data of the head C3 was produced so that a substituted head of the head C3 was the head Hr. The area RC3 of the porous part Ps in the head C3 is larger than the area RC2 of the porous part Ps in the head C2. The area RC3 of the porous part Ps in the head C3 includes the whole area RC2 of the porous part Ps in the head C2. The area rate Ra of the porous part Ps was 64%.

A line L4 in FIG. 12 shows a contour line of a porous part Ps of the head C4. The line L4 is a contour line outside the darkest portion in FIG. 12. Three-dimensional data of the head C4 was produced in the same manner as in the head 2 except that a whole area RC4 inside the line L4 was the porous part Ps. The three-dimensional data of the head C4 was produced so that a substituted head of the head C4 was the head Hr. The area RC4 of the porous part Ps in the head C4 is larger than the area RC3 of the porous part Ps in the head C3. The area RC4 of the porous part Ps in the head C4 includes the whole area RC3 of the porous part Ps in the head C3. The whole sole was the porous part Ps in the head C4. The area rate Ra of the porous part Ps was 100%.

The porous part Ps used for the heads C1 to C4 had a three-layer structure shown in FIG. 10. Porosity of a skin layer Ls was set to 0.00%. Physical properties of the skin layer Ls were made the same as those of the titanium alloy. Porosity of a core layer Lc was assumed to be about 35%. Under the assumption, physical properties of the core layer Lc were determined. As the physical properties of the core layer Lc, an elastic modulus was set to 37.8 GPa; a density was set to 2873 kg/m$^3$; and a Poisson ratio was set to 0.35. The physical properties of the core layer Lc were determined by referring to Figure "relationship between elastic modulus and porosity of porous alloy" described in The Japan Institute of Metals (Nihon-Kinzoku gakkai), Annual autumn meeting (the 135th) outline (2004), p. 466. The head Hr (sole thickness: 0.7 mm) was a substituted head. As a result, a thickness Ts of the skin layer Ls was 0.20 mm, and a thickness Tc of the core layer Lc was 0.46 mm.

Figure 13:
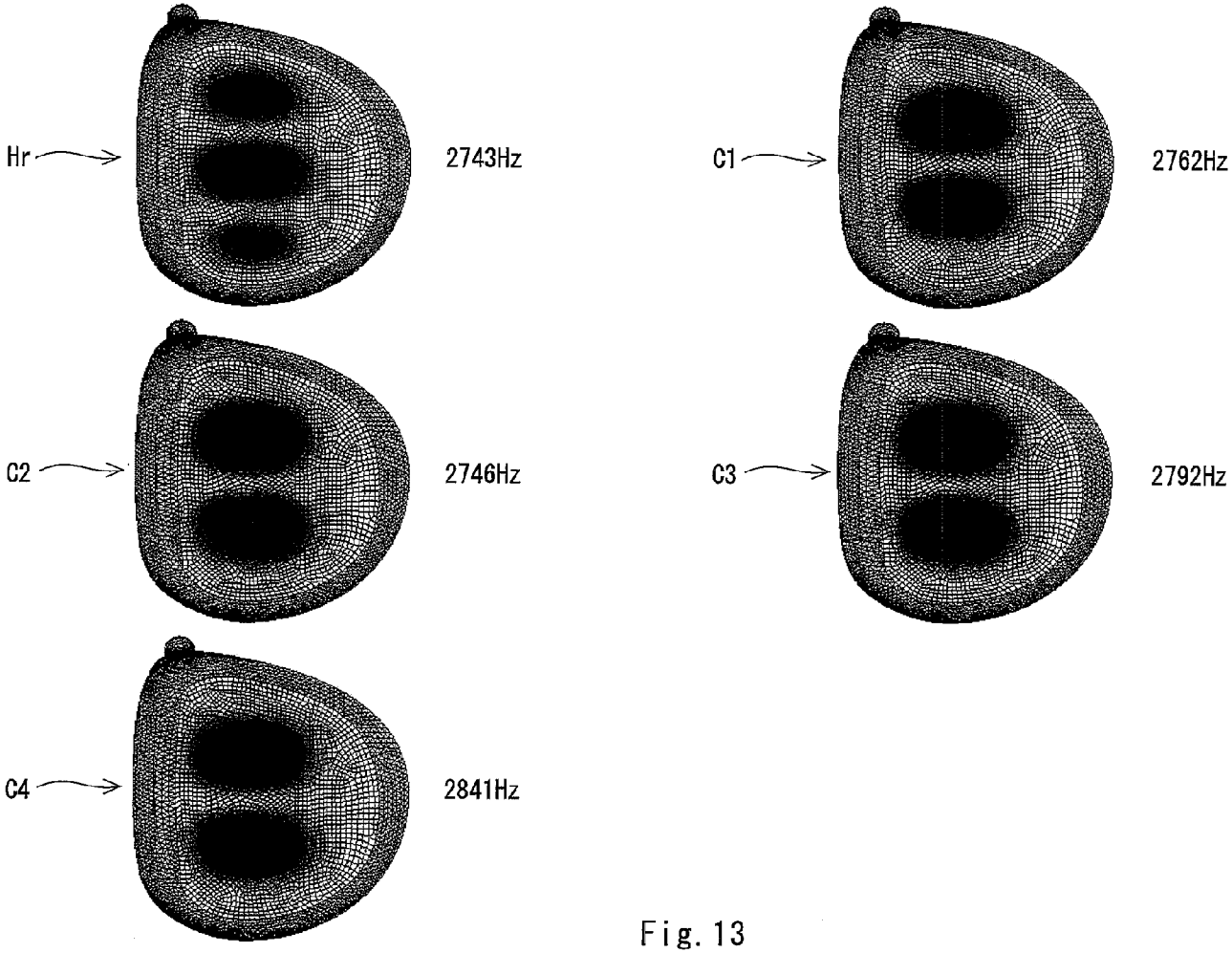
FIG. 13 shows simulation images of the examples (heads C1, C2, C3, and C4)

FIG. 13 shows simulation results of the head C1, the head C2, the head C3, and the head C4. FIG. 13 is an image viewed from a sole side, and shows a vibration form of a sole. A contrasting density of FIG. 13 shows a form of natural vibration of a first-order mode. A darker portion has a greater amplitude.

As the result of the simulation, the natural frequency of the first-order mode was as follows. A natural frequency Fp1 of the head Hr was 2743 Hz. A natural frequency F1 of the head C1 was 2762 Hz. A natural frequency F1 of the head C2 was 2746 Hz. A natural frequency F1 of the head C3 was 2792 Hz. A natural frequency F1 of the head C4 was 2841 Hz. In all of the heads C1 to C4, the natural frequency F1 of the first-order mode was greater than the natural frequency Fp1 of the substituted head Hr.

[Evaluation B: Effects of Thickness of Skin Layer and Porosity of Core Layer on Rigidity]

Effects of the thickness Ts of the skin layer and the porosity of the core layer on the rigidity of the porous part were confirmed under a condition where a weight was constant.

In the simulation, a base body A was first considered. The base body A has no pore. A thickness of the base body A is T; a density is ρ; and an elastic modulus is E. Since the base body A has no pore, distinction of the core layer and the skin layer does not exist. That is, in the base body A, the thickness Ts of the skin layer is 0 mm. The thickness T was set to 0.7 mm. The density ρ was set to 4420 kg/m$^3$. E was set to 126 GPa.

Next, a large number of test bodies B were considered. A weight and a material of each of the test bodies B were made the same as those of the base body A. Each of the test bodies B has the core layer and the skin layer. The core layer has pores. The skin layer has no pore. A density and an elastic modulus of the skin layer are the same as those of the base body A. Flexural rigidity of each of the test bodies B was compared with that of the base body A.

A thickness h of each of the test bodies B is represented by the following formula.

$$h=Ts+Ts+Tc$$

Since the weight of each of the test bodies B is the same as that of the base body A, the thickness Tc of the core layer of each of the test bodies B is represented by the following formula.

$$Tc=\rho/\rho p(T-2\times Ts)$$

ρp is a density of the core layer.

Flexural rigidity EIb of each of the test bodies B is represented by the following formula considering a second moment of area in a rectangular section.

$$EIb=W\times\{(Ep-E)\times Tc^3+E\times h^3\}/12$$

W is a width of the rectangular section; and Ep is an elastic modulus of the core layer.

The relationship between the elastic modulus E and the elastic modulus Ep is represented by the following formula.

$$Ep=E\times(\rho p/\rho)^{\alpha}$$

α was set to 2.79 by referring to Figure described in The Japan Institute of Metals (Nihon-Kinzoku gakkai), Annual autumn meeting outline (2004), p. 466. α was determined so that an elastic modulus ratio [(Ep/E)×100] was 30% when the porosity was 0.35.

Figure 14:
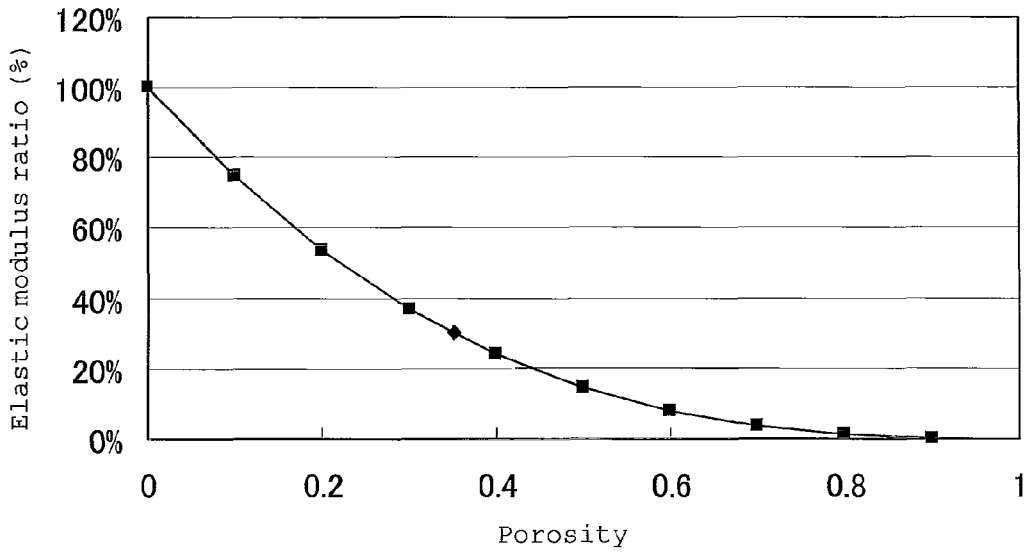
FIG. 14 is a graph showing the relationship between porosity and an elastic modulus ratio.

The relationship between the porosity and the elastic modulus ratio (Ep/E) is as shown in a graph of FIG. 14 based on the above mentioned conditions.

In the test bodies B, a rigidity ratio [EIb/EIa] and a skin layer ratio were calculated by changing the thickness Ts of the skin layer and the porosity of the core layer. The rigidity ratio [EIb/EIa] was calculated by dividing flexural rigidity EIb of each of the test bodies B by flexural rigidity EIa of the base body A. Calculation results of the rigidity ratio are shown in the following Table 1. Calculation results of the skin layer ratio are shown in the following Table 2.

TABLE 1

Rigidity ratio when thickness Ts of skin layer and porosity of core layer are changed

| | Ts(mm) | | | | | | | |
|---|---|---|---|---|---|---|---|---|
| Porosity | Ts = 0 | Ts = 0.05 | Ts = 0.1 | Ts = 0.15 | Ts = 0.2 | Ts = 0.25 | Ts = 0.3 | Ts = 0.35 |
| 0 | 1.00 | 1.00 | 1.00 | 1.00 | 1.00 | 1.00 | 1.00 | 1.00 |
| 0.1 | 1.02 | 1.09 | 1.13 | 1.14 | 1.12 | 1.09 | 1.05 | 1.00 |
| 0.2 | 1.05 | 1.22 | 1.31 | 1.32 | 1.29 | 1.21 | 1.11 | 1.00 |
| 0.3 | 1.08 | 1.40 | 1.56 | 1.59 | 1.51 | 1.37 | 1.19 | 1.00 |
| 0.35 | 1.09 | 1.52 | 1.73 | 1.76 | 1.66 | 1.48 | 1.24 | 1.00 |
| 0.4 | 1.11 | 1.66 | 1.93 | 1.98 | 1.85 | 1.61 | 1.30 | 1.00 |
| 0.5 | 1.15 | 2.09 | 2.54 | 2.60 | 2.38 | 1.97 | 1.47 | 1.00 |

TABLE 2

Skin layer ratio when thickness Ts of skin layer and porosity of core layer are changed

| | Ts(mm) | | | | | | | |
|---|---|---|---|---|---|---|---|---|
| Porosity | Ts = 0 | Ts = 0.05 | Ts = 0.1 | Ts = 0.15 | Ts = 0.2 | Ts = 0.25 | Ts = 0.3 | Ts = 0.35 |
| 0 | 0 | 14 | 29 | 43 | 57 | 71 | 86 | 100 |
| 0.1 | 0 | 13 | 26 | 40 | 55 | 69 | 84 | 100 |
| 0.2 | 0 | 12 | 24 | 38 | 52 | 67 | 83 | 100 |
| 0.3 | 0 | 10 | 22 | 34 | 48 | 64 | 81 | 100 |
| 0.35 | 0 | 10 | 21 | 33 | 46 | 62 | 80 | 100 |
| 0.4 | 0 | 9 | 19 | 31 | 44 | 60 | 78 | 100 |
| 0.5 | 0 | 8 | 17 | 27 | 40 | 56 | 75 | 100 |

As the results of Table 1 show, the rigidity ratios of all the test bodies B are greater than 1.00 regardless of the thickness Ts of the skin layer and the porosity. That is, the test bodies B of all variations shown in Table 1 exhibited flexural rigidity higher than that of the base body A. It was found that the rigidity is enhanced so the porosity is higher. It was found that the rigidity is enhanced as compared with that of the base body A when no skin layer exists, that is, even when Ts is 0. As the results show, the porous part has an effect of enhancing the flexural rigidity without increasing the weight. The effect contributes increase of a frequency of a hitting sound.

The results of Table 1 show that a numerical value range suitable for the thickness Ts of the skin layer exists. Table 1 shows that preferable rigidity can be obtained when the thickness Ts of the skin layer is 0.05 mm or greater and 0.3 mm or less. As Table 1 shows, in the range, a rigidity ratio of equal to or greater than 1.3 tends to be obtained. Furthermore, when the thickness Ts of the skin layer was 0.15 mm, the rigidity ratio exhibited the maximum value.

A preferable skin layer ratio (%) in the examples can be understood by contrasting Table 1 with Table 2. That is, a skin layer ratio capable of achieving a high rigidity ratio is preferable. In this respect, a skin layer ratio (%) is preferably 8% or greater, and a skin layer ratio (%) is preferably 80% or less. When the porosity of the core layer is 0.2 or greater and 0.5 or less and the skin layer ratio (%) is 8% or greater and 80% or less, the rigidity ratio (Table 1) is equal to or greater than 1.21, and is good.

As these results show, the advantages of the present invention are apparent.

The head described above can be applied to all hollow golf club heads.

The description hereinabove is merely for an illustrative example, and various modifications can be made in the scope not to depart from the principles of the present invention.

What is claimed is:

1. A golf club head having a sole, a crown, a face, a hosel, and a hollow part inside thereof, wherein the sole comprises both a porous portion and a non-porous portion, the porous portion is formed from a porous metal including a large number of small pores, the porous portion is integrally joined to the non-porous portion, the non-porous portion is formed from a metal or carbon fiber reinforced plastic, at least a part of the porous portion occupies the entire thickness of the sole, an outer surface of the porous portion forms an outer surface of the sole, and an inner surface of the porous portion is exposed to the hollow part.

2. The golf club head according to claim 1, wherein the area of the sole that comprises the porous portion that occupies the entire thickness of the sole is equal to or greater than 15% of the entire sole.

3. The golf club head according to claim 1, wherein the porous portion and the non-porous portion are integrally joined by welding.

4. The golf club head according to claim 1, wherein the volume of the head is 400 cc or greater and 470 cc or less.

5. The golf club head according to claim 1, wherein the porous portion has a porosity of at least 25%.

6. The golf club head according to claim 1, wherein the porous and non-porous portions of the sole are each formed from a titanium alloy.

7. The golf club head according to claim 1, wherein the porous portion of the sole is formed from a titanium alloy.

8. A golf club head having a sole, a crown, a face and a hosel, wherein the sole comprises both a porous portion and a non-porous portion, the porous portion is formed from a porous metal, the porous portion is integrally joined to the non-porous portion, the non-porous portion is formed from a metal or carbon fiber reinforced plastic, the porous portion has two skin layers and a core layer located between the skin layers, each of the skin layers has a porosity smaller than the porosity of the core layer.

9. The golf club head according to claim 8, wherein the porosity of each of the skin layers is equal to or less than 5%.

10. The golf club head according to claim 8, wherein the porosity of the core layer is equal to or greater than 25%.

11. The golf club head according to claim 8, wherein the thickness of each of the skin layers is 0.05 mm or greater and 0.5 mm or less.

12. The golf club head according to claim 8, wherein the thickness of the core layer is 0.2 mm or greater and 1.0 mm or less.

13. The golf club head according to claim 8, wherein the ratio of the thickness of the skin layers to the entire thickness of the porous portion is defined as a skin layer ratio, and the skin layer ratio is 8% or greater and 80% or less.

14. The golf club head according to claim 8, wherein the skin layers have a porosity of 5% or less and the core layer has a porosity of 25% or more.

15. The golf club head according to claim 8, wherein the porous and non-porous portions of the sole are each formed from a titanium alloy.

16. The golf club head according to claim 8, wherein the porous portion of the sole is formed from a titanium alloy.

* * * * *